US005103502A

United States Patent [19]

Grilliot et al.

[11] Patent Number: 5,103,502

[45] Date of Patent: * Apr. 14, 1992

[54] FIREFIGHTER'S COAT HAVING SECURE WRIST PROTECTION

[76] Inventors: William L. Grilliot; Mary I. Grilliot, both of 1986 Home Ave., Dayton, Ohio 45417

[ * ] Notice: The portion of the term of this patent subsequent to Mar. 19, 2008 has been disclaimed.

[21] Appl. No.: 668,775

[22] Filed: Mar. 13, 1991

Related U.S. Application Data

[63] Continuation of Ser. No. 473,595, Feb. 1, 1990, Pat. No. 4,999,849, which is a continuation of Ser. No. 312,463, Feb. 21, 1989, Pat. No. 4,924,529.

[51] Int. Cl.[5] ..... A41B 7/00

[52] U.S. Cl. ..... 2/123; 2/93; 24/15

[58] Field of Search ..... 2/16, 17, 59, 85, 93, 2/123, 125, 161 A; 24/15, 41; D2/222.1, 624, 625

[56] References Cited

U.S. PATENT DOCUMENTS

| | | | |
|---|---|---|---|
| 255,552 | 3/1882 | Webster | 24/15 |
| 301,640 | 7/1884 | Swan | 2/101 |
| 302,072 | 7/1884 | Welde | 24/15 |
| 419,635 | 1/1890 | Butts | 24/15 |
| 597,883 | 1/1898 | Kepler | 24/15 |
| 1,328,545 | 1/1920 | O'Shea | 2/161 A |
| 1,667,583 | 4/1928 | Black | 24/15 |
| 2,123,969 | 7/1938 | Rosenblatt | 2/93 |
| 2,430,745 | 11/1947 | St. Pierre | 2/59 |
| 3,889,297 | 6/1975 | Jarboe | 2/123 |
| 4,631,753 | 12/1986 | Ehring | 2/85 |
| 4,709,421 | 12/1987 | Grilliot | 2/93 |

FOREIGN PATENT DOCUMENTS

| | | | |
|---|---|---|---|
| 62948 | 7/1915 | Austria | 24/15 |
| 273977 | 5/1914 | Fed. Rep. of Germany | 24/15 |
| 458608 | 10/1913 | France | 24/15 |
| 287546 | 5/1928 | France | 2/59 |
| 1915 | 1/1916 | United Kingdom | 24/15 |

*Primary Examiner*—Werner H. Schroeder
*Assistant Examiner*—Diana L. Biefeld
*Attorney, Agent, or Firm*—Jacox & Meckstroth

[57] ABSTRACT

A firefighter's coat which has sleeve portions which cover the wrists of a firefighter who wears the coat. Each sleeve portion has an edge part adjacent a hand of the firefighter. A strip of flexible material is connected to the edge part of the sleeve portion. The strip of flexible material is adapted to be positioned between two digits of the hand of the firefighter, such as between the thumb and the adjacent finger of the hand of the firefighter. Thus, the sleeve portion is maintained in covering relationship upon the wrist of the firefighter, even while the arms and hands of the firefigher are actively moved in a firefighting operation.

7 Claims, 1 Drawing Sheet

FIREFIGHTER'S COAT HAVING SECURE WRIST PROTECTION

RELATED APPLICATION

This application is a continuation of application Ser. No. 07/473,595, filed Feb. 1, 1990, now U.S. Pat. No. 4,999,849, which is a continuation of application Ser. No. 07/312,463, filed Feb. 21, 1989, now U.S. Pat. No. 4,924,529.

BACKGROUND OF THE INVENTION

Firefighter's coats have been traditionally constructed with relatively short tubular members or wristlets of knitted material which terminate adjacent the hands of the wearer of the coat. A wristlet comprises an extension of the sleeve portion of one of the protective layers in a firefighter's coat. However, when a firefighter's coat has relatively short wristlets, and when the firefighter wears conventional gloves, an unprotected gap may exist between a wristlet and a glove, and thus an unprotected gap exists in the wrist region between a firefighter's hands and arms. This is particularly true when a firefighter's hands and arms are raised over the firefighter's head or when the arms and hands are extended outwardly from the firefighter's body. Such gaps expose a part of the wrist region of the firefighter, and thus protection in the wrist region is inadequate when the firefighter's arms are raised or extended.

Firefighters have used gloves having long cuffs to protect against the occurrence of such unprotected gaps in the wrist region of a firefighter. However, when a firefighter's glove with long cuffs becomes wet, difficulty is experienced in donning and removing the glove, and a firefighter's gloves must be donned and doffed frequently at the fire scene to permit apparatus adjustments to be made. Therefore, long cuff gloves are not satisfactory.

For these reasons, firefighters' coats have been constructed with longer wristlets in an attempt to eliminate the occurrence of unprotected gaps in the wrist region of a firefighter. A firefighter's coat is never removed at a fire scene. Therefore, a wet coat cuff is not a don/doff problem. A wet glove wristlet presents a problem.

The long wristlets are, by necessity, of flexible material. Experience has shown that long wristlets also present a problem due to the fact that bunching and rolling of a long wristlet occurs as the firefighter's arms are moved upwardly and downwardly and extended from the body and retracted.

Attempts have been made to stabilize the long wristlets and to avoid bunching and rolling in the wristlet. One such attempt comprises stitching a short longitudinally extending seam in the end of the long wristlet to provide a short tube through which the firefighter's thumb extends, with the remainder of the firefighter's hand extending from the end of the long wristlet. Thus, the long wristlet is maintained in proper position and is maintained against bunching and rolling as the firefighter works. It has been found, however, that the short longitudinally extending seam exerts a strain on the knitted material of the long wristlet, and the stitching causes the long wristlet to have weakened portions. Furthermore, the short tube created by the longitudinal stitching sometimes causes irritation in the thumb region of the firefighter. Furthermore, such a tube which accomodates the firefighter's thumb causes the wristlet to be too tight around the hand of the firefighter.

Another attempt to eliminate bunching and rolling in the long wristlets of a firefighter's coat has been the provision of a thumb hole in a side portion of tho long wristlet. When a hole is cut in the side portion of the long wristlet to provide an opening for the thumb, the knit material of the wristlet is weakened significantly. Therefore, such a wristlet is not satisfactory.

Another attempt in solving the problem of bunching in a long wristlet pertains to the forming of a hole in the side portion of the wristlet. In order to reduce the weakening of the wristlet by the formation of a hole therein, the wristlet material has been turned or rolled and stitched around the edge of the hole. However, such a rolled region presents a lump between the thumb and the index finger of the firefighter's hand. Therefore, such a wristlet in a firefighter's coat is not satisfactory.

It is therefore an object of this invention to provide a long wristlet in a firefighter's coat and in which the wristlet is readily and automatically correctly positioned upon the firefighter as the firefighter dons the coat.

Another object of this invention is to provide such a firefighter's coat in which the long wristlet includes means for maintaining the wristlet in proper protective position, without rolling and bunching.

It is another object of this invention to provide a firefighter's coat with such a wristlet which is not weakened by cutting or stitching and in which the wristlet is comfortable upon tho wrist and hand of the firefighter and in which the wristlet is not reduced in dimension by the means which retains the wristlet in proper position.

Other objects and advantages of this invention reside in the construction of parts, the combination thereof, the method of production and the mode of use, as will become more apparent from the following description.

SUMMARY OF THE INVENTION

This invention pertains to a firefighter's coat which has arm length sleeves and which includes wristlets in the form of long tubular protective members which extend from the ends of the sleeves and which protect the wrist regions of the firefighter. This invention includes means for maintaining the long tubular members in proper covering relationship upon the wrists of the firefighter.

Each wristlet includes a tab or loop attached to the end portion of the tubular member. The tab or loop is positioned to receive a thumb or finger of the firefighter's hand as the firefighter's hand moves through the tubular member. The tab or loop becomes positioned between two of the digits of the firefighter's hand, such as between the thumb and the index finger. Thus, the tab retains the position of the tubular protective member upon a firefighter's hand and arm. Thus, the tubular protective member is maintained in proper position even while the firefighter works and engages in vigorous arm and hand action.

DETAILED DESCRIPTION OF THE PREFERRED EMBODIMENT

Figure 1:
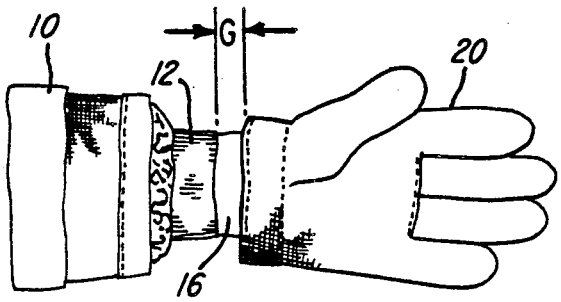
FIG-1 (PRIOR ART)
FIG. 1 is a fragmentary elevational view illustrating a prior art condition in which a conventional wristlet extends from a sleeve of a firefighter's coat and in which the firefighter's hand is covered by a conventional glove. This view illustrates a problem involved due to the fact that a gap exists between the wristlet and the glove. Thus, a portion of the wrist of the firefighter between the sleeve and the glove is exposed.

FIG. 1 illustrates a sleeve 10 of a conventional coat of a firefighter. A conventional wristlet 12 extends from the sleeve 10 and partially covers a wrist 16 of the firefighter. The firefighter also wears a glove 20. In this situation a gap G exists between the wristlet 12 and the glove 20. Thus, a portion of the wrist 16 of the firefighter is exposed and is not protected. Of course, such a condition is not satisfactory in the protection of a firefighter.

As stated above, firefighters have worn long gloves or gloves with a long cuff in order to eliminate a gap between the wristlet and the glove. However, it has been found that such a glove, when wet, is difficult to don and to remove. Thus, a long glove or a glove having a long cuff is not satisfactory for protection of a firefighter.

In this invention means are provided for maintaining a long wristlet in proper covering relationship upon the wrist of a firefighter.

Figure 2:
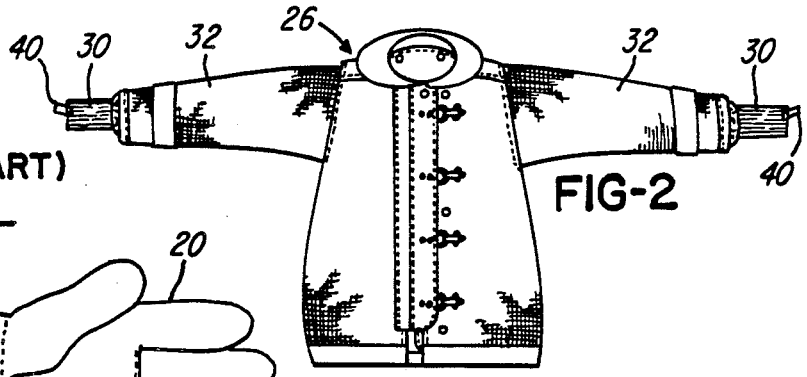
FIG. 2 is a front elevational view, drawn on a much smaller scale that FIG. 1, showing a firefighter's coat which includes wristlets in the form of long tubular wrist protectors of this invention.

FIG. 2 shows a firefighter's coat 26 which includes wristlets of this invention which comprise long tubular members 30. The long tubular members 30 extend from sleeves 32. The long tubular members 30 are extensions of one of the protective layers of the coat 26.

Figure 3:
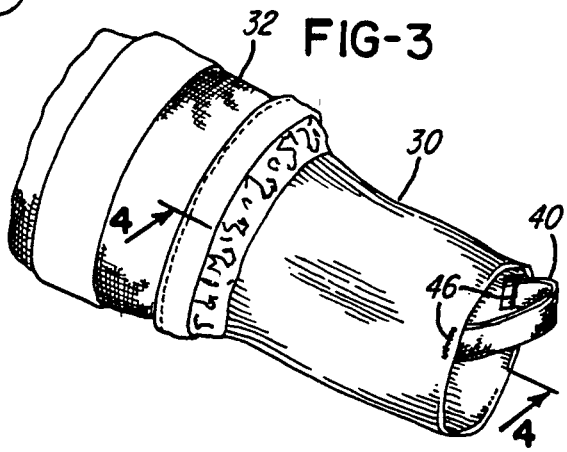
FIG. 3 is a fragmentary perspective view, drawn on a much larger scale than FIG. 2, showing one of the long tubular wrist protectors of FIG. 2.
Figure 4:
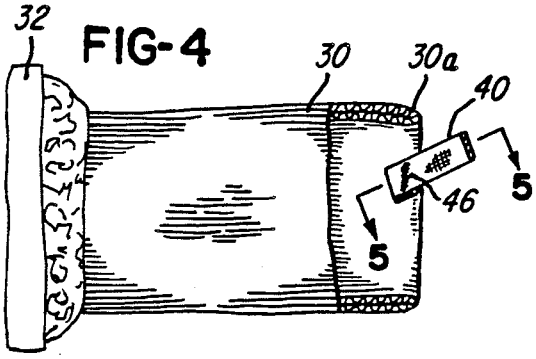
FIG. 4 is a sectional view, with parts broken away, taken substantially on line 4—4 of FIG. 3, and drawn on substantially the same scale as FIG. 3.
Figure 5:
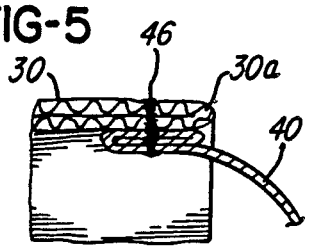
FIG. 5 is an enlarged fragmentary sectional view taken substantially on line 5—5 of FIG. 4.

As illustrated, a tubular member or wristlet 30 covers the wrist of a firefighter who wears the coat 26. The tubular member 30 has an end edge portion 30*a*, which is shown as being folded, thus forming two layers in the tubular member 30. Attached to the end edge portion 30*a* of each tubular member 30 is a strip 40. Spaced-apart portions of the strip 40 are stitched to the end edge portion 30*a* by elongate tacks 46. Thus, the strip 40 forms a loop which extends from the tubular member 30, as best shown in FIGS. 3 and 4. The strip 40 and a part of the edge portion 30*a* form a small passage in the end edge portion 30*a* of the tubular member 30. Preferably, the elongate tacks 46 are normal to the longitudinal axis of the tubular member 30. When the tacks 46 are normal to the longitudinal axis of the tubular member 30, the tacks 46 are of maximum strength and are less likely to cause tearing of the end edge portion 30*a* of the tubular member 30.

Figure 6:
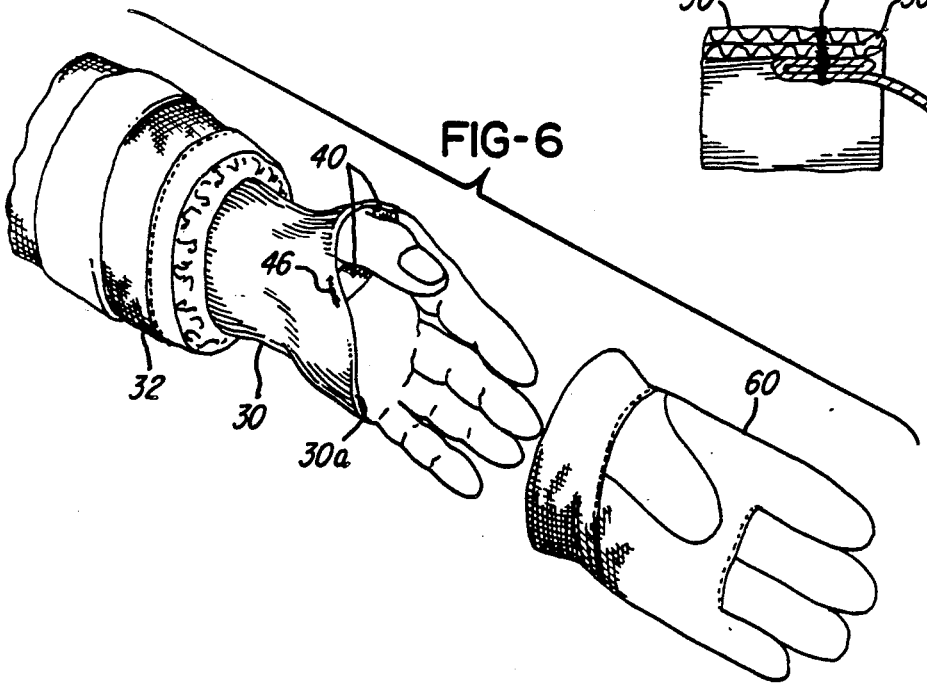
FIG. 6 is a perspective exploded view, drawn on substantially the same scale as FIGS. 3 and 4, and illustrating the position of a wristlet of this invention as the wristlet covers a firefighter's wrist and a portion of the firefighter's hand. This figure also illustrates the position of the thumb with respect to the tubular member. This figure also illustrates the use of a glove to cover the hand of the firefighter.

As illustrated in FIG. 4, the strip 40 is positioned at an angle with respect to the end edge portion 30*a*. As illustrated in FIG. 6, when a firefighter dons the coat 26, the arms and hands of the firefighter move through the sleeves 32, and each hand extends from one of the long tubular members 30. As the hand is moved through the tubular member 30 the firefighter's thumb is moved through the small passage formed by the strip 40 and by a part of the end edge portion 30*a* of the tubular member 30. Thus, the strip 40 is positioned between the thumb and the index finger of the firefighter and serves as a retainer member for the thumb. Thus, the tubular member 30 is maintained in proper covering relationship to the wrist of the firefighter, even while the firefighter's arms and hands are actively engaged in firefighting.

It is to be understood however, that the strip 40 may be positioned at the end edge portion 30*a* of the tubular member 30 to receive a finger or fingers of the hand of the firefighter, rather than the thumb, to retain the tubular member 30 in proper covering portion upon the wrist of the firefighter.

It is also to be understood that each tubular member 30 may comprise an integral part of a sleeve 32 of the firefighter's coat 26.

FIG. 6 illustrates the donning of a glove 60 to cover the firefighter's hand. The glove 60 may be relatively short in length, and therefore easy to don. The glove 60, when donned, may cover all or part of the tubular member 30.

Although the preferred embodiment of tho firefighters' coat having wrist protection of this invention has been described, it will be understood that within the purview of this invention various changes may be made in the form, details, proportion and arrangement of parts, the combination thereof, and the mode of use, which generally stated consist in a structure within the scope of the appended claims.

The invention having thus been described, the following is claimed:

1. A firefighter's coat of the type having a body portion and a pair of sleeve portions, the body portion and the sleeve portions including firefighting protective material including thermal protective material, the firefighter's coat including a pair of tubular members, each of the tubular members including thermal protective material, each of the tubular members extending from one of the sleeve portions, each of the tubular members being adapted to extend from the sleeve portion to a hand of a firefighter who wears the firefighter's coat and to cover the wrist of the firefighter, each tubular member having an attachment region, a pair of flexible retainer members, there being a flexible retainer member for each of the tubular members, each flexible retainer member being provided with a connection portion, means connecting the connection portion of each flexible retainer member to the attachment region of one of the tubular members, whereby the flexible retainer member includes a loop at the attachment region of the tubular member, the loop being adapted to receive and retain a thumb of a firefighter as the firefighter dons the firefighter's coat, whereby the flexible retainer member is positioned between the thumb and the index finger of the hand of the firefighter, and whereby the tubular member is continuously maintained in covering protective relationship over the wrist of the firefighter as the firefighter's arms and hands are moved in a firefighting operation.

2. The firefighter's coat of claim 1 in which each tubular member has a longitudinal axis and in which the means connecting the connection portion of each flexible retainer member to the attachment region of a tubular member comprises elongate stitch means which are normal to the longitudinal axis of the tubular member.

3. A firefighter's coat of the type having a body portion and sleeve portion the body portion and the sleeve portions comprising firefighting protective material including thermal protective material, each of the sleeve portions having an end part which is adapted to cover a wrist of the firefighter who wears the firefighter's coat, the end part of each sleeve portion including an attachment region, a flexible retainer member, the flexible retainer member being provided with a connection portion, means connecting the connection portion of the flexible retainer member to the end part of one of the sleeve portions, whereby the flexible retainer member includes a loop at the end part of the sleeve portion, the loop being adapted to receive a thumb of a hand of a firefighter as the firefighter dons the firefighter's coat, whereby the flexible retainer member is positioned between the thumb and the index finger of a hand of the firefighter, and whereby the end part of the sleeve portion is continuously maintained in covering protective relationship over the wrist of the firefighter as the firefighter's arms and hands are moved in a firefighting operation.

4. A method of continuously protecting the wrist area of a firefighter who wears a firefighter's coat which is provided with a body portion and a pair of sleeve portions with each of the sleeve portions having an end part, the body portion and the sleeve portions comprising firefighting protective material including thermal protective material, positioning an end part of each of the sleeve portions of the firefighter's coat adjacent a hand of the firefighter who wears the firefighter's coat, whereby the end part of the sleeve portion covers the wrist area of the firefighter who wears the firefighter's coat, the method comprising providing the end part of each sleeve portion with an attachment region, providing a pair of strips of flexible material, providing each flexible strip with a connection portion, connecting the connection portion of each strip of flexible material to the attachment region of the end part of one of the sleeve portions, positioning each strip of flexible material between two digits of a hand of the firefighter who wears the firefighter's coat, whereby the end parts of the sleeve portions are continuously maintained in covering relationship upon the wrist areas of the firefighter who wears the firefighter's coat during firefighting movement of the arms and hands of the firefighter who wears the firefighter's coat.

5. A method of continuously protecting the wrist area of a firefighter who wears a firefighter's coat which is provided with a body portion and a pair of sleeve portions, the body portion and the sleeve portions including firefighting protective material which includes thermal protective material, comprising providing a pair of tubular extension protective members in which each of the tubular extension protective members includes thermal protective material, forming in each tubular extension protective member an attachment region, connecting each tubular extension protective member to a sleeve portion of the firefighter's coat and extending the tubular extension protective member from the sleeve portion of the firefighter's coat to a hand of the firefighter who wears the firefighter's coat with the attachment region being adjacent the hand of the firefighter, whereby the tubular extension protective member covers the wrist area of the firefighter who wears the firefighter's coat, providing a pair of strips of flexible material in which each of the strips of flexible material has a connection portion, connecting the connection portion of each strip of flexible material to the attachment region of one of the tubular extension protective members, positioning each strip of flexible material between two digits of a hand of the firefighter who wears the firefighter's coat, whereby the tubular extension protective members are continuously maintained in covering relationship over the wrist areas of the firefighter who wears the firefighter's coat during movement of the arms and hands of the firefighter who wears the firefighter's coat.

6. The method of claim 5 in which each tubular extension protective member has a longitudinal axis and which includes connecting the connection portion of each strip of flexible material to the attachment region of the tubular extension protective member by stitching through the attachment region and through the connection portion of the strip of flexible member in a formation which is substantially normal to the longitudinal axis of the tubular protective extension member.

7. The method of claim 5 which includes forming in each tubular extension protective member a fold region which creates a double layer in the attachment region of the tubular extension protective member and which includes connecting the connection portion of each of the strips of flexible material to the double layer in the attachment region of the tubular extension protective member.

* * * * *